United States Patent [19]

Wingard

[11] 4,250,507

[45] Feb. 10, 1981

[54] DIRECTIONAL CIRCULAR LOOP BEAM ANTENNA

[76] Inventor: Jefferson C. Wingard, Rte. #1 Country Pl., Anderson, S.C. 29621

[21] Appl. No.: 974,063

[22] Filed: Dec. 28, 1978

[51] Int. Cl.[3] ..... H01Q 7/00

[52] U.S. Cl. ..... 343/742; 343/876

[58] Field of Search ..... 343/741, 742, 743, 866, 343/873, 876

[56] References Cited

U.S. PATENT DOCUMENTS

| | | | |
|---|---|---|---|
| 2,373,660 | 4/1945 | Closson | 343/873 |
| 3,284,801 | 11/1966 | Bryant | 343/742 |
| 3,491,361 | 1/1970 | Cambbell | 343/835 |
| 3,532,315 | 10/1970 | Partridge | 343/742 |
| 3,671,973 | 6/1972 | French | 343/797 |
| 4,138,682 | 2/1979 | Doherty | 343/742 |

FOREIGN PATENT DOCUMENTS

| | | | |
|---|---|---|---|
| 850974 | 10/1960 | United Kingdom | 343/742 |

OTHER PUBLICATIONS

McCloud, Radio Communication Jul. 1975, p. 533.

*Primary Examiner*—Eli Lieberman
*Attorney, Agent, or Firm*—Bailey, Dority & Flint

[57] ABSTRACT

A directional horizontal beam antenna is disclosed having a pair of driven circular loop elements mechanically coupled and carried closely adjacent one another in a vertical manner producing a directional signal which may be shifted between vertical and horizontal polarization wherein the circular loop elements are formed by a plurality of flexible straight sections having a unique construction.

5 Claims, 6 Drawing Figures

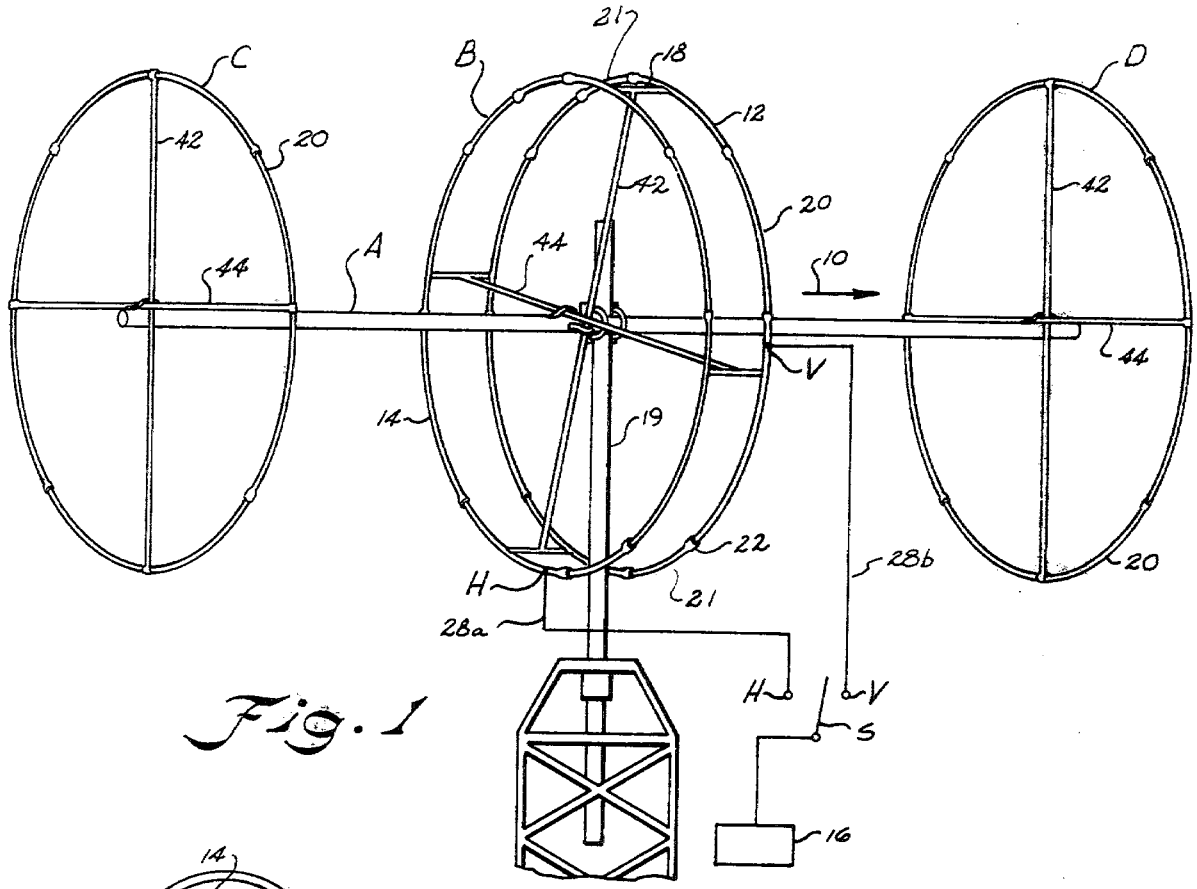
Fig. 1
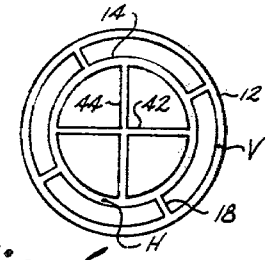
Fig. 6
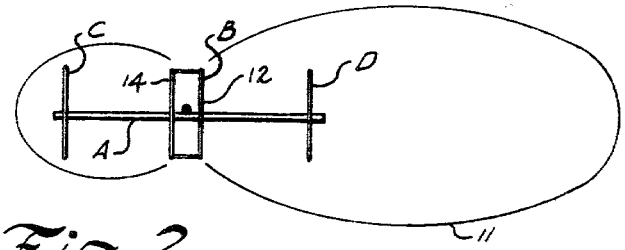
Fig. 2
Fig. 3
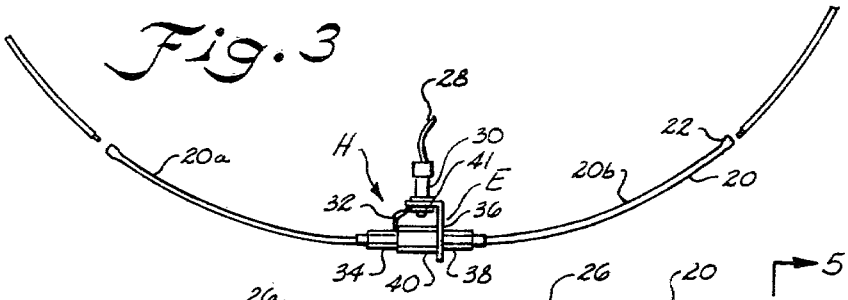
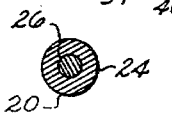
Fig. 5
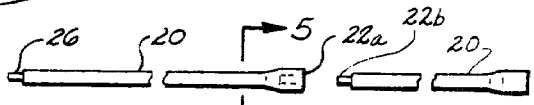
Fig. 4

DIRECTIONAL CIRCULAR LOOP BEAM ANTENNA

BACKGROUND OF THE INVENTION

Various horizontal beam antennas have been known which function primarily as directional antennas. With the increasing use of radio transmitting and receiving apparatus, the frequency spectrum has become increasingly congested, and it has become desirable to switch between horizontal and vertical mode of operation to avoid congestion when possible. Furthermore, with the increasing use of mobile radio units, the majority of which use vertically polarized antennas, it has become desirable to have the facility for vertical mode operation to allow effective communication with mobile units.

One attempt to provide a dual polarity directional antenna has been the provision of a quad antenna having a reflector loop and a single driven loop wherein conductive cross-arms are utilized together with an electrical network to drive the quad loop in either the vertical or horizontal mode. However, the additional electrical network required to obtain dual polarity increases the cost of having such capability as well as the complexity of the unit. Further, due to the arrangement of the quad antenna in four equal legs, the signals arrive out of phase at the central determination point reducing its effectiveness.

U.S. Pat. No. 3,284,801 discloses a large loop beam antenna wherein the loops are constructed of a plurality of tubular metallic sections which are sprung into a curved shape and fastened end to end. However, such are susceptible to being bent during shipping and handling resulting in loss in structural integrity. Non-conducting material is required to reinforce and support the loop configuration.

SUMMARY OF THE INVENTION

It has been found that a directional beam antenna can be provided having a pair of vertically oriented circular driven loop element which are mechanically carried adjacent one another and adapted for either vertical or horizontal polarization of the resulting directional signal by switching between the driven loops. When combined with a circular reflector loop element, a resulting directional signal is produced in one direction along the axis of the horizontal beam wherein the symmetrical circular loops achieve greater gain by keeping signal distances equal.

Accordingly, it is an important object of the present invention to provide a directional beam antenna in which the polarization can be shifted between the vertical and horizontal modes which eliminates the need for additional electrical network and elaborate electrical harnessing.

Another important object of the present invention is the provision of a directional beam antenna having circular radiating element providing equal signal distances achieving greater gain.

Yet another important object of the present invention is the provision of a directional beam antenna having circular loop elements which are formed by a plurality of straight flexible sections of unique construction.

Yet another important object of the present invention is the provision of a directional beam antenna having circular loop elements formed from a plurality of flexible sections wherein the conductor is encapsulated in a resin matrix providing structural rigidity to the assembled antenna and while affording flexibility to form the loop.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 1 is a perspective view illustrating a directional beam antenna constructed in accordance with the present invention;

FIG. 2 is an illustration of the directional signal pattern produced by a directional antenna according to the invention;

FIG. 3 is an enlarged elevational view of a part of a circular antenna loop element constructed according to the invention;

FIG. 4 is an elevational view illustrating the individual sections which comprise a circular loop element constructed according to the invention;

FIG. 5 is a sectional view taken along line 5—5 of FIG. 4, and

FIG. 6 is a schematic illustration illustrating an alternate arrangement for the pair of driven loop elements.

DESCRIPTION OF THE PREFERRED EMBODIMENT

Referring now to the drawing, a directional beam antenna having dual polarity capabilities is illustrated as including a horizontal beam axis A, a pair of separately driven circular loop elements B vertically carried about the beam axis, and a circular reflector loop element C carried vertically about the beam axis for directing the signal outwardly in the direction of arrow 10 along the horizontal beam axis generally in a pattern shown as 11. The pair of driven loop elements B are mechanically coupled and carried in a spaced apart relationship closely adjacent one another but are not electrically coupled. A first of the loop elements 12 is adapted for connection at terminal V for vertical polarization and a second of the loop elements 14 is adapted for connection at terminal H for horizontal polarization. Thus, connection of either of the driven loop elements to a radio 16 may be had by any suitable switch means S for selectively producing a directional pattern along the horizontal beam axis A either vertically or horitonzally polarized.

In the preferred embodiment, the driven loop elements 12 and 14 are arranged in vertical planes parallel to one another in the spaced apart relationship and a minimum distance is required to reduce mutual coupling between the loops. The distance, of course, depending on the frequency of operation may vary; however, for example, for loop elements twelve feet in diameter operating at a frequency of 30 megacycles, a minimum distance of 5 to 6 inches is required. It is also contemplated that the driven loop elements 12 and 14 may be concentrically arranged relative to one another by constructing one of the loops of a smaller diameter of the other and nesting the loop within the other as illustrated schematically in FIG. 6. A conventional tuning network may be utilized to tune the loops as desired.

This construction may be conveniently and readily had in accordance with the present invention due to the unique construction of the circular loop elements as will be more fully hereinafter explained. It is also preferred that the driven loop elements 12 and 14 have a circumference equal generally to one wave length at their operating frequency to afford maximum performance.

At least one parasitic circular loop element D is provided mechanically connected and carried by horizontal beam A serving as a director for the signal pattern.

Mechanical connection between loop 12 and 14 may be had in any suitable manner using any suitable hardware such as spacing arms 18 connected thereto. The loops as a unit may then be mounted to vertical mast pole 19 and horizontal beam A as required using suitable hardware.

Referring now to FIG. 3, the construction of the circular loop elements is illustrated as including a plurality of individual flexible fiberglass radiating sections 20 joined together at their ends by a ferrule connection 22 including socket 22*a* and plug 22*b*. Each section 20 includes a center aluminum conductor core 24 encapsulated by an outer layer 26 of reinforced fiberglass or other suitable reinforcing non-conductive material which gives the section structural rigidity while allowing it to bend and form the closed circular loop configuration or any other closed curved configuration. The socket and plug of the furrule connection are conductively connected to center core 24 of each radiating section so that a continuous conductive path may be established around the loop when joined. The length of section 20 is normally four or five feet for shipping convenience, however, shorter lengths may be supplied for varying and adjusting the overall loop size and characteristics as desired. The section diameter is appoximately ¼ of an inch. Loop elements twelve feet in diameter have been utilized and balanced for wind load.

Terminal connection to the driven loops 12 and 14 at V and H may be made by any suitable means such as by terminal connector E. Two of the radiating sections 20*a* and 20*b* are specially adapted for connecting each loop to a power source. Coaxial cable lead 28*a*, connected between switch terminal H and connector E, is received within threaded femal connector 30 and the center conductor thereof makes electrical connection with element 20*a* through connector 32 and a threaded female connector 34 which is affixed to radiating element 20*a* and conductively receives the center conductor core 26 thereof. The outside electrical conductor of coaxial cable 28*a* makes electrical connection with section 20*b* through connector 36 and threaded electrical connector 38 affixed to radiating section 20*b*. Members 40 and 41 are insulating members. Conductive connectors 34 and 38 are threaded into member 40. It is to be understood, of course, that other conventional hardware may also be utilized for making the aforedescribed electrical and mechanical connection. Similar termination may be provided at terminal V at loop 12 for coaxial cable 28*b* connected to switch terminal V. It has been found that vertical polarization of loop 14 at a matched frequency with loop 12 may be enhanced by placing a short dielectric section 21 in the vertically driven loop adjacent the top and bottom whereby half of theloop is driven at V with the other portion acting as a reflector.

Any suitable coaxial switch may be used at S such as a Model 442 coaxial switch manufactured by the Winn-Tenna Corporation of Anderson, S.C.

The unique construction of the radiation elements affords use of rigid cross arms 42 and 44 connected to the loop elements such as by convention "T" connection hardware for supporting and maintaining loop configuration which may be made of any suitable material without regard to conductivity. The overall construction provides a highly versatile and improved structure for a large loop antenna which are typically cumbersome, complex, and expensive. Furthermore, the effect of encapsulated conductor 26 further minimizes any mutual coupling between the driven loop 14 and 12 enabling them to be arranged in closer juxtaposed position for producing essentially the same gain and pattern in either the horizontal or vertical mode. The cross arms 42 and 44 may be connected to spacing arms 18 as illustrated using suitable "T" connection hardware.

Thus, it can be seen that a directional, dual polarity antenna can be had in accordance with the ivention of simple construction wherein a pair of driven loops are mechanically carried adjacent one another which are not coupled electrically to produce a direction signal pattern which may be shifted in polarity without elaborate harnessing and elaborate harnessing and electrical network. The symmetrical loop configuration provides increased gain by keeping signal distances equal and loop construction including encapsulated conductors minimizes mutual coupling between the elements as well as providing simplified and improved construction for large loop antennas.

While a preferred embodiment of the invention has been described using specific terms, such description is for illustrative purposes only, and it is to be understood that changes and variations may be made without departing from the spirit or scope of the following claims.

What is claimed is:

1. A directional antenna array comprising:

a horizontal beam axis;

a pair of individually driven circular loop elements carried vertically about said beam axis non-electrically coupled to one another;

a circular reflector loop element carried vertically about said beam axis adjacent said pair of driven loop elements;

a first of said driven loop elements being adapted for vertical polarization;

a second of driven loop elements being adapted for horizontal polarization; and said first and second driven loop elements being mechanically coupled in a spaced apart relationship closely adjacent one another;

input terminal means connected to said loop elements adapted for connection to a power source so that operation may be had for selectively producing a directional pattern along said horizontal beam axis which may be shifted between the vertical or horizontal polarization modes; and said driven loop elements including a plurality of individual radiating sections joined end-to-end, each said section including a center conductive core encapsulated by a reinforced dielectric material affording structural rigidity enabling said sections to bend for assembly and disassembly, said dielectric material reducing mutual coupling between said driven loops enabling closer juxtaposed positioning in said antenna array.

2. The structure of claim 1 wherein said pair of driven loop elements are arranged parallel in said spaced apart relationship.

3. The structure of claim 1 wherein said pair of driven elements are arranged concentrically in said spaced apart relationship.

4. The structure of claim 1 wherein each of said driven loop elements has a circumference equal generally to one wave length at an operating frequency.

5. The structure of claim 1 including at least one loop director element carried vertically about said horizontal beam axis enhancing the direction and gain along said beam axis.

* * * * *